US009084035B2

(12) United States Patent
Gustavsson

(10) Patent No.: US 9,084,035 B2
(45) Date of Patent: Jul. 14, 2015

(54) SYSTEM AND METHOD OF DETECTING A PLUG-IN TYPE BASED ON IMPEDANCE COMPARISON

(71) Applicant: QUALCOMM Incorporated, San Diego, CA (US)

(72) Inventor: Bengt Stefan Gustavsson, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 339 days.

(21) Appl. No.: 13/771,800

(22) Filed: Feb. 20, 2013

(65) Prior Publication Data

US 2014/0233741 A1 Aug. 21, 2014

(51) Int. Cl.
*H04R 3/00* (2006.01)
*H04R 5/04* (2006.01)

(52) U.S. Cl.
CPC .. *H04R 3/00* (2013.01); *H04R 5/04* (2013.01); *H04R 2420/05* (2013.01)

(58) Field of Classification Search
None
See application file for complete search history.

(56) References Cited

U.S. PATENT DOCUMENTS

| | | | |
|---|---|---|---|
| 7,099,481 | B2 | 8/2006 | Baker et al. |
| 7,366,577 | B2 | 4/2008 | DiSanza et al. |
| 7,579,832 | B1 | 8/2009 | Blackburn et al. |
| 7,916,875 | B2 | 3/2011 | Kanji |
| 8,014,539 | B2 | 9/2011 | Song et al. |
| 8,244,927 | B2 | 8/2012 | Chadbourne et al. |
| 2006/0147059 | A1 | 7/2006 | Tang et al. |
| 2008/0003955 | A1 | 1/2008 | Rutkowski et al. |
| 2009/0108854 | A1 | 4/2009 | Agevik et al. |

FOREIGN PATENT DOCUMENTS

| | | | |
|---|---|---|---|
| JP | 2008028953 | A | 2/2008 |
| WO | 2004001552 | A2 | 12/2003 |

OTHER PUBLICATIONS

International Search Report and Written Opinion for International Application No. PCT/US2014/016046, ISA/EPO, Date of Mailing May 16, 2014, 11 pages.

"A Guide to Measurement Technology and Techniques", Agilent Impedance Measurement Handbook, Agilent Technologies, 4th Edition, 2009, 140 pp.

*Primary Examiner* — Paul Huber
(74) *Attorney, Agent, or Firm* — Toler Law Group, PC

(57) ABSTRACT

A particular method includes determining, at an electronic device having a plug-in port, a plug-in type of an accessory connected to the plug-in port based on a comparison of an alternating current (AC) impedance at the plug-in port to a direct current (DC) impedance at the plug-in port.

31 Claims, 6 Drawing Sheets

SYSTEM AND METHOD OF DETECTING A PLUG-IN TYPE BASED ON IMPEDANCE COMPARISON

I. FIELD

The present disclosure is generally related to detecting a plug-in type based on impedance comparison.

II. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and internet protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player. Also, such wireless telephones can process executable instructions, including software applications, such as a web browser application, that can be used to access the Internet. As such, these wireless telephones can include significant computing capabilities.

Some devices may include audio ports which are capable of receiving plugs associated with different types of devices. For example, an audio port with a 3.5 millimeter (mm) jack can receive a plug of a headset or a plug of a speaker. An end user experience may be improved by identification of a type of a device plugged into an audio port.

When an accessory is plugged into a 3.5 mm jack, impedance may be measured using a ramped direct current (DC) voltage. The impedance may be used to determine whether the accessory is a headset, a line-out cable that is plugged at an opposite end (e.g., plugged into a car or a home stereo), or a line-out cable that is unplugged at the opposite end (e.g., an extension cable).

One drawback of identifying the type of the plugged in accessory using DC impedance measurements alone is an overlap region in the impedance of headsets and line-outs. For example, the overlap region of headsets and line-outs may be between approximately 600 Ohms and 7000 Ohms. Similarly, there may be an overlap region in the impedance of a capacitor-coupled line-out and a line-out cable that is unplugged at the other end. When the DC impedance is in an overlap region, the type of device may not be reliably determined using DC impedance measurements alone.

III. SUMMARY

Systems and methods of detecting a plug-in type based on impedance comparison are disclosed. The disclosed embodiments utilize impedance comparison to determine a type of a plugged-in device and modify an audio signal to the device based on the type of the plugged-in device.

For example, the disclosed techniques may distinguish between passive accessories (e.g., headsets/headphones) and active accessories (e.g., line-outs). Low impedance passive accessories (e.g., high sensitivity head phones) may have a DC impedance of less than 200 Ohms. The active accessories may not overlap in this region of DC impedance (i.e., less than 200 Ohms). Thus, passive accessories with low impedance may be distinguished from active accessories based solely on DC impedance measurement. However, the active accessories may overlap a DC impedance associated with other types of passive accessories (i.e., not low impedance passive accessories). By utilizing impedance variance over frequency (e.g., due to an electro-dynamic transducer), the other types of passive accessories may be distinguished from the active accessories. For example, active accessories may have a flatter impedance vs. frequency response in a passband than the other types of passive accessories (i.e., not low impedance passive accessories). The disclosed techniques may also include distinguishing between alternating current (AC)-coupled line-outs and line-outs that are unplugged at the other end.

Audio output signal levels may be adjusted and user interface improvements may be made based on the identified type of the device. When headphones are detected, a lower audio output signal level may be desirable than when a line-out is detected. For example, industry and/or regulatory standards (e.g., EN50332 in the European Union) may outline a safe maximum level to prevent possible hearing damage due to long-term exposure to loud audio levels. To illustrate, a standard may outline a maximum audio signal level for headsets of 150 milli-Volt (mV) root means square (rms) using a particular pseudo noise signal that has a crest factor of 13 dB (peak to rms ratio) across 32 Ohms.

In a particular embodiment, a method includes determining, at an electronic device having a plug-in port, a plug-in type of an accessory connected to the plug-in port based on a comparison of an alternating current (AC) impedance at the plug-in port to a direct current (DC) impedance at the plug-in port.

In another particular embodiment, a non-transitory computer-readable medium stores instructions that, when executed by a processor, cause the processor to determine a maximum audio signal level based on a comparison of an alternating current (AC) impedance at a plug-in port to a direct current (DC) impedance at the plug-in port.

In another particular embodiment, an apparatus includes a plug-in type detector configured to determine a plug-in type of an accessory connected to a plug-in port based on a comparison of an alternating current (AC) impedance at the plug-in port to a direct current (DC) impedance at the plug-in port.

In another particular embodiment, an apparatus includes a plug-in port. The apparatus also includes a plug-in type detector configured to determine a plug-in type of an accessory connected to the plug-in port based on a comparison of an alternating current (AC) impedance at the plug-in port to a direct current (DC) impedance at the plug-in port. The apparatus further includes an impedance comparator configured to receive an AC impedance value representative of the AC impedance at the plug-in port, to receive a DC impedance value representative of the DC impedance at the plug-in port, to compare the AC impedance value to the DC impedance value, and to provide a result of the comparison to the plug-in type detector.

One particular advantage provided by at least one of the disclosed embodiments is enabling plug-in type determination of plugged-in devices with overlapping DC impedance regions.

Other aspects, advantages, and features of the present disclosure will become apparent after review of the entire application, including the following sections: Brief Description of the Drawings, Detailed Description, and the Claims.

IV. DETAILED DESCRIPTION

Figure 1:
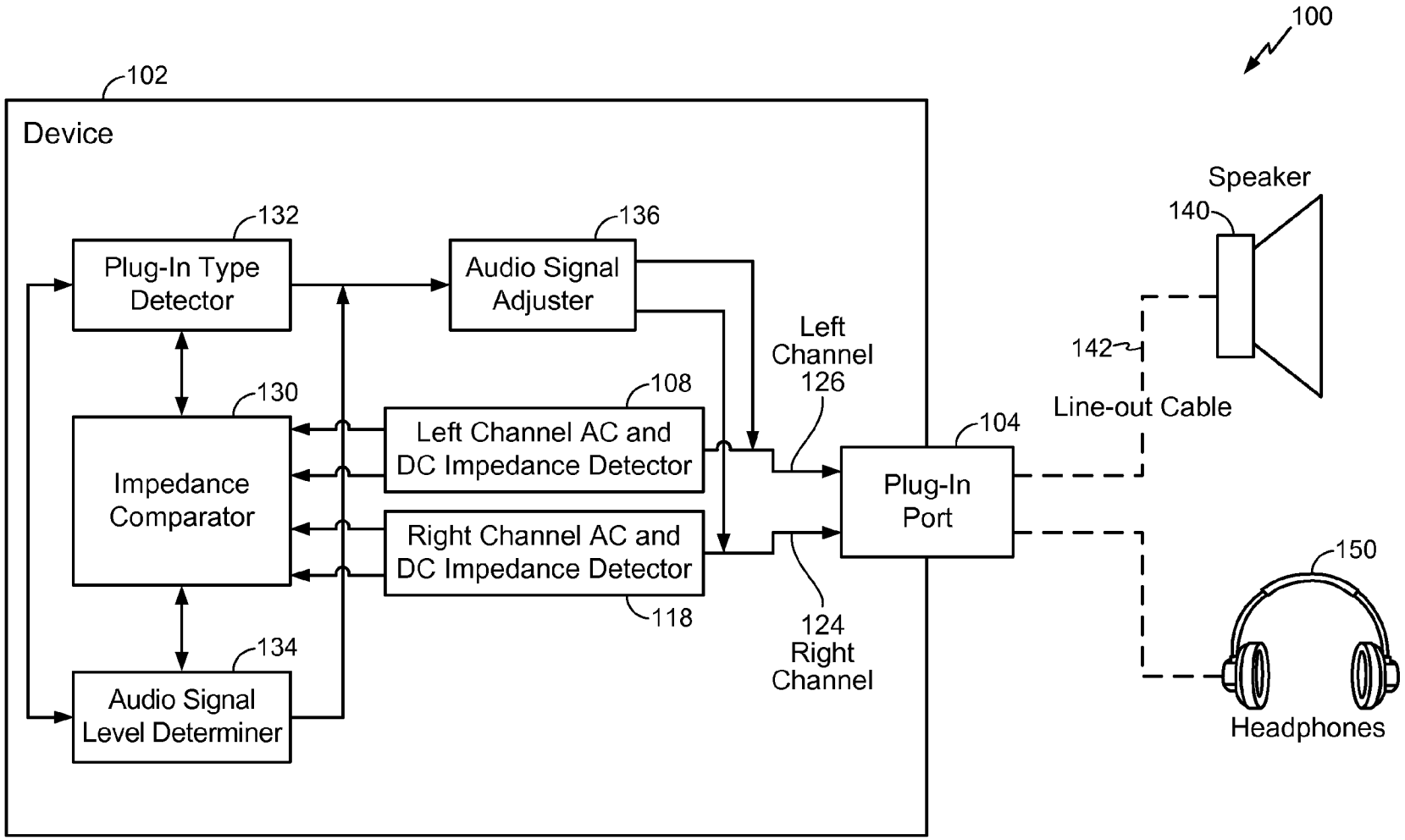
FIG. 1 is a diagram of a particular embodiment of a system that is operable to detect plug-in type based on impedance comparison.

Referring to FIG. 1, a diagram of a particular embodiment of a system that is operable to detect a plug-in type is disclosed and generally designated 100. The system 100 includes an electronic device 102 (e.g., a car stereo system, a hand-held device, a mobile phone, a laptop, a sound system, a computing device, a digital video disc player, a set-top box device, a television, etc.) that may be selectively coupled to a speaker 140 or to headphones 150 via a plug-in port 104 that includes a left channel 126 and a right channel 124. The left channel 126 may be coupled to an impedance comparator 130 via a left channel AC and DC impedance detector 108. The right channel 124 may be coupled to the impedance comparator 130 via a right channel AC and DC impedance detector 118. The impedance comparator 130 may be coupled to a plug-in type detector 132 and to an audio signal level determiner 134. The plug-in type detector 132 and the audio signal level determiner 134 may be coupled to the left channel 126 and to the right channel 124 via an audio signal adjuster 136. In particular embodiments, components of the electronic device 102 may be implemented in hardware and/or as instructions executable by a processor, as further described with reference to FIG. 6.

Although FIG. 1 shows a single plug-in port (i.e., the plug-in port 104) with two channels (i.e., the left channel 126 and the right channel 124), in other embodiments the electronic device 102 may include multiple plug-in ports and a plug-in port may have fewer than two or more than two channels.

Each channel AC and DC impedance detector (e.g., the left channel AC and DC impedance detector 108 and the right channel AC and DC impedance detector 118) may detect an AC impedance and a DC impedance of the corresponding channel (e.g., the left channel 126 or the right channel 124). The AC impedance may be measured at a particular frequency (e.g., approximately 100 Hz). An illustrative embodiment of operation of a channel AC and DC impedance detector is described in further detail with reference to FIG. 2. The DC impedance(s) may be compared with the AC impedance(s) by the impedance comparator 130.

The plug-in type detector 132 may determine whether a plug-in type of an accessory connected to the plug-in port 104 is a headset/headphones type (e.g., the headphones 150), a line-out type (e.g., line-out cable 142), an AC coupled line-out type, or a disconnected cable type. As used herein, "headphones" may include one or more audio output channels (e.g., the right channel 124, the left channel 126, or both) but no microphone. A "headset" may include a microphone as well as one or more audio output channels. A "line-out" may include a cable with one or more audio output channels.

In an illustrative embodiment, the plug-in type detector 132 may determine that the plug-in type is headphones (or headset) in response to the impedance comparator 130 indicating that the DC impedance (e.g., of one or both channels) is below 200 Ohms or that the AC impedance (e.g., of one or both channels) at the particular frequency is substantially higher than the DC impedance (e.g., of one or both channels). In a particular embodiment, the AC impedance may be substantially higher than the DC impedance when the AC impedance is greater than or equal to 110 percent of the DC impedance. In another particular embodiment, the AC impedance is substantially higher than the DC impedance. In this case, a difference between the AC impedance and the DC impedance is sufficient to rule out errors in measurement of the AC impedance and the DC impedance.

The plug-in type detector 132 may determine that the plug-in type is a line-out in response to the impedance comparator 130 indicating that the AC impedance is substantially equal to the DC impedance. In a particular embodiment, the AC impedance may be substantially equal to the DC impedance when the AC impedance is greater than 90 percent and less than 110 percent of the DC impedance. The plug-in type detector 132 may determine that the plug-in type is an AC coupled line-out in response to the impedance comparator 130 indicating that the AC impedance is substantially lower than the DC impedance. In a particular embodiment, the AC impedance may be substantially lower than the DC impedance when the AC impedance is less than or equal to 90 percent of the DC impedance. In another particular embodiment, the AC impedance is substantially lower than the DC impedance. A difference between the DC impedance and the AC impedance is sufficient to rule out errors in measurement of the AC impedance and the DC impedance.

The plug-in type detector 132 may determine that the plug-in type is a disconnected cable in response to the impedance comparator 130 indicating that the AC impedance and the DC impedance are above a threshold. In a particular embodiment, the threshold may be 700,000 Ohms. In another particular embodiment, the threshold may be approximately 10 percent below a maximum impedance detection level. For example, a particular channel AC and DC impedance detector (e.g., the left channel AC and DC impedance detector 108 or the right channel AC and DC impedance detector 118) may be capable of detecting a maximum impedance of 600,000 Ohms. The threshold may be approximately 540,000 Ohms, i.e., approximately 10 percent below the maximum impedance detection level. In another particular embodiment, the percentage that the threshold is below the maximum impedance detection level may be determined based on the maximum impedance detection level. For example, the threshold may be a lower percentage of a lower maximum impedance detection level than of a higher maximum impedance detection level. To illustrate, the threshold may be 10 percent below a maximum impedance detection level if the maximum impedance detection level is above a particular value (e.g., 100,000 Ohms) The threshold may be 5 percent below a maximum impedance detection level if the maximum impedance detection level is below another particular value (e.g., 40,000 Ohms).

The audio signal level determiner 134 may select a maximum audio signal level of the plug-in port 104 based on the detected plug-in type (e.g., based on the impedance comparison). For example, in response to determining that a line-out cable is unplugged at the other end, the maximum audio signal level may be set to 0 milli-volts root mean square (mVrms). In response to determining that the plug-in type is headset/headphones, the maximum audio signal level of a full scale sinusoidal audio signal output via the plug-in port 104 may be set to about 474 milli-volts root mean square (mVrms). In response to determining that the plug-in type is a line-out, the maximum audio signal level of a full scale sinusoidal audio signal output via the plug-in port 104 may be set to about 1 volt root mean square (Vrms). In a particular embodiment, in response to determining that the plug-in type is headset/headphones, the maximum audio signal level of an audio signal output via the plug-in port 104 having a crest factor of 13 dB may be set to about 150 mVrms. In response to determining that the plug-in type is line-out, the maximum audio signal level of an audio signal output via the plug-in port 104 having a crest factor of 13 dB may be set to about 320 mVrms. In a particular embodiment, the maximum audio signal level may be selected based on safe maximum audio levels specified by industry and/or regulatory standards (e.g., EN50332 in the European Union).

The audio signal adjuster 136 may modify an audio signal output based on the maximum audio signal level. For example, the audio signal adjuster 136 may modify the audio signal output to be at or below the maximum audio signal level determined by the audio signal level determiner 134. Thus, the audio signal adjuster 136 may enable compliance with regulatory guidelines for particular types of plug-in accessories. Moreover, the audio signal adjuster 136 may advantageously enforce such guidelines only in appropriate situations (e.g., a maximum headphone/headset output level may be enforced only if a headphone/headset is detected). This may provide an enhanced user experience as compared to systems that do not have the ability to accurately identify the plugged-in accessory, and thus enforce regulatory guidelines on all accessory types (e.g., limit a line-out output level to comply with a headphone/headset guideline). The audio signal adjuster 136 may send the modified audio signal output via the plug-in port 104.

In a particular embodiment, the audio signal level determiner 134 may select the maximum audio signal level based on the impedance comparison without an intermediate step of determining the plug-in type. For example, in response to the impedance comparator 130 indicating that the AC impedance at a particular frequency and the DC impedance are above a threshold (e.g., 700,000 Ohms or approximately 10% below a maximum impedance detection level), the maximum audio signal level may be set to 0 milli-volts root mean square (mVrms). In response to the impedance comparator 130 indicating that the DC impedance is below 200 Ohms or that the AC impedance is substantially higher than the DC impedance, the maximum audio signal level of a full scale sinusoidal audio signal output via the plug-in port 104 may be set to about 474 milli-volts root mean square (mVrms). In response to the impedance comparator 130 indicating that the AC impedance is substantially equal to the DC impedance, the maximum audio signal level may be set to about 1 volt root mean square (Vrms). In response to the impedance comparator 130 indicating that the AC impedance is substantially lower than the DC impedance, the maximum audio signal level may be set to about 1 volt root mean square (Vrms).

In a particular embodiment, an AC impedance may be measured for each of the right channel 124 and the left channel 126 and the impedance comparator 130 may use an average AC impedance value in a comparison with a DC impedance value. Alternatively, or in addition, the DC impedance may be measured for each of the right channel 124 and the left channel 126 and the impedance comparator 130 may use an average DC impedance value in a comparison with an AC impedance value.

Thus, an audio signal adjustment technique in accordance with the foregoing description compares an AC impedance at a particular frequency to a DC impedance to enable accurate detection of plug-in type. Other approaches for plug-in type detection (e.g., approaches that do not utilize AC and DC impedance comparison) may be subject to plug-in type detection errors due to DC impedance overlap regions. By providing more accurate plug-in type identification, a better user experience may be delivered as audio signal output levels may be adjusted more reliably based on accessory type. User interface improvements may also be made as applications more accurately identify the type of a plugged-in device. For example, different user interfaces, applications, and options may be displayed/enabled at an electronic device based on what type of accessory is connected to the electronic device.

Figure 2:
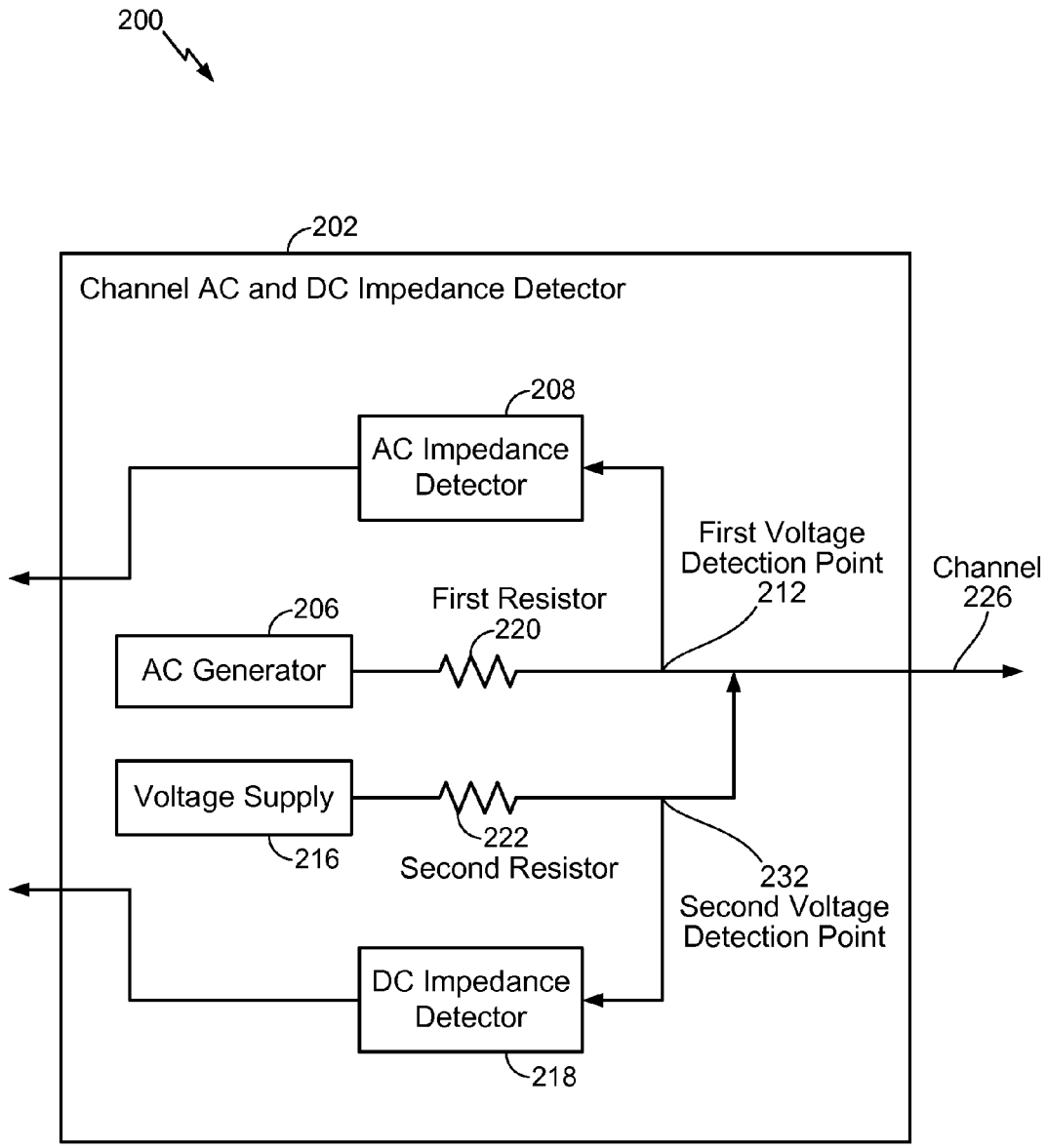
FIG. 2 is a diagram of a particular illustrative embodiment of a channel AC and DC impedance detector of the system of FIG. 1.

FIG. 2 depicts a particular illustrative embodiment of a channel AC and DC impedance detector (e.g., the left channel AC and DC impedance detector 108 of FIG. 1, the right channel AC and DC impedance detector 118 of FIG. 1, or both). The channel AC and DC impedance detector 202 includes an AC generator 206 coupled to a channel 226 (e.g., the left channel 126 of FIG. 1 or the right channel 124 of FIG. 1). A first resistor 220 may be coupled between the channel 226 and the AC generator 206. The channel 226 may also be coupled to a voltage supply 216 via a second resistor 222. Each of the resistors 220 and 222 may have a known resistance. The channel 226 may be coupled to an AC impedance detector 208 and to a DC impedance detector 218.

In operation, the voltage supply 216 may apply a known voltage to enable DC impedance measurement by a DC impedance detector 218. The DC impedance detector 218 may detect a DC voltage of the channel 226 at a second voltage detection point 232. The DC impedance detector 218 may determine a DC impedance of the channel 226 based on the detected DC voltage. For example, the DC impedance detector 218 may determine the DC impedance of the channel 226 by comparing the detected DC voltage to a reference voltage. To illustrate, a table stored in a memory of an electronic device may map reference voltage values (e.g., threshold voltage values) to DC impedance values, and the DC impedance detector 218 may match the detected DC voltage to a reference voltage in the table to determine a corresponding DC impedance value. As another example, the DC impedance detector 218 may determine the DC impedance of the channel 226 by multiplying the detected DC voltage with a ratio of the known resistance of the second resistor 222 and the known voltage.

In a particular embodiment, the detected DC voltage may be quantized in an analog-to-digital convertor (ADC) and the quantized detected DC voltage may be used to determine the DC impedance. For example, the DC impedance detector 218 may compare the quantized detected DC voltage to the reference voltage values of the table to determine a corresponding DC impedance value. As another example, the DC impedance detector 218 may calculate the DC impedance value based on the quantized detected DC voltage, such as by multiplying the quantized detected DC voltage with the ratio of the known resistance of the second resistor 222 and the known voltage.

To measure an AC impedance of a channel (i.e., the left channel 126 or the right channel 124), the AC generator 206 may generate a signal at a particular frequency (e.g., approximately 100 Hz, such as between 90 Hz and 110 Hz) with a known voltage (i.e., amplitude). For example, the signal may correspond to a noise signal generated by a hardware noise oscillator. Measuring the AC impedance of the channel may include impedance sensing (e.g., using voltage sensors to detect voltage and determine the impedance based on the voltage). An AC impedance detector 208 (e.g., a voltage sensor) may detect an AC voltage of the channel 226 at a first voltage detection point 212. In a particular embodiment, the AC impedance detector 208 may detect a root mean square (rms) AC voltage based on determining a peak AC voltage.

The AC impedance detector 208 may determine an AC impedance of the channel 226 based on the detected AC voltage. For example, the AC impedance detector 208 may determine the AC impedance of the channel 226 by comparing the detected AC voltage to a reference voltage. To illustrate, a table in memory may map reference voltage values to AC impedance values and the AC impedance detector 208 may match the detected AC voltage to a reference voltage in the table to determine a corresponding AC impedance value. As another example, the AC impedance detector 208 may calculate the AC impedance of the channel 226 based on the AC voltage. To illustrate, the AC impedance detector 208 may determine the AC impedance of the channel 226 based on an absolute value of a complex ratio of the detected AC voltage and the known voltage. In a particular embodiment, the AC impedance detector 208 may determine the AC impedance of the channel 226 by multiplying the detected AC voltage with a ratio of the known resistance of the first resistor 220 and the known voltage.

The channel AC and DC impedance detector 202 may measure the AC impedance using a bridge method, a resonant method, a current-voltage (I-V) method, a resistance frequency current-voltage (RF I-V) method, a network analysis method, or an auto-balancing bridge method. For example, when using the bridge method, the channel AC and DC impedance detector 202 may include bridge elements and may determine the AC impedance based on a relationship of the bridge elements. The bridge elements may include a combination of inductor (L), capacitor (C), and resistor (R) components. As another example, when using the resonant method, the channel AC and DC impedance detector 202 may include a tuning capacitor and may determine the AC impedance based on a capacitance of the tuning capacitor and a detected voltage across the tuning capacitor. As a further example, when using the I-V method, the channel AC and DC impedance detector 202 may include a resistor (e.g., the first resistor 220) and may determine the AC impedance based on a detected AC voltage and a known resistance of the resistor. As another example, when using the RF I-V method, the channel AC and DC impedance detector 202 may include an impedance-matched measurement circuit and may determine the AC impedance based on a detected AC voltage and a known resistance of a resistor. As a further example, when using the network analysis method, the channel AC and DC impedance detector 202 may include a directional coupler or bridge and may determine the AC impedance based on a reflected signal. As another example, when using the auto-balancing bridge method, the channel AC and DC impedance detector 202 may include a high terminal and a resistor and may determine the AC impedance based on a first detected AC voltage at the high terminal and a second detected AC voltage across the resistor.

In a particular embodiment, the detected AC voltage may be quantized in an analog-to-digital convertor (ADC) and the quantized detected AC voltage may be used to determine the AC impedance. For example, the AC impedance detector 208 may compare the quantized detected AC voltage to the reference voltage values of the table to determine a corresponding AC impedance value. As another example, the AC impedance detector 208 may calculate the AC impedance value based on the quantized detected AC voltage.

The AC impedance detector 208, the DC impedance detector 218, or both may output signal(s) indicating the detected impedance value(s) to the impedance comparator 130.

Figure 3:
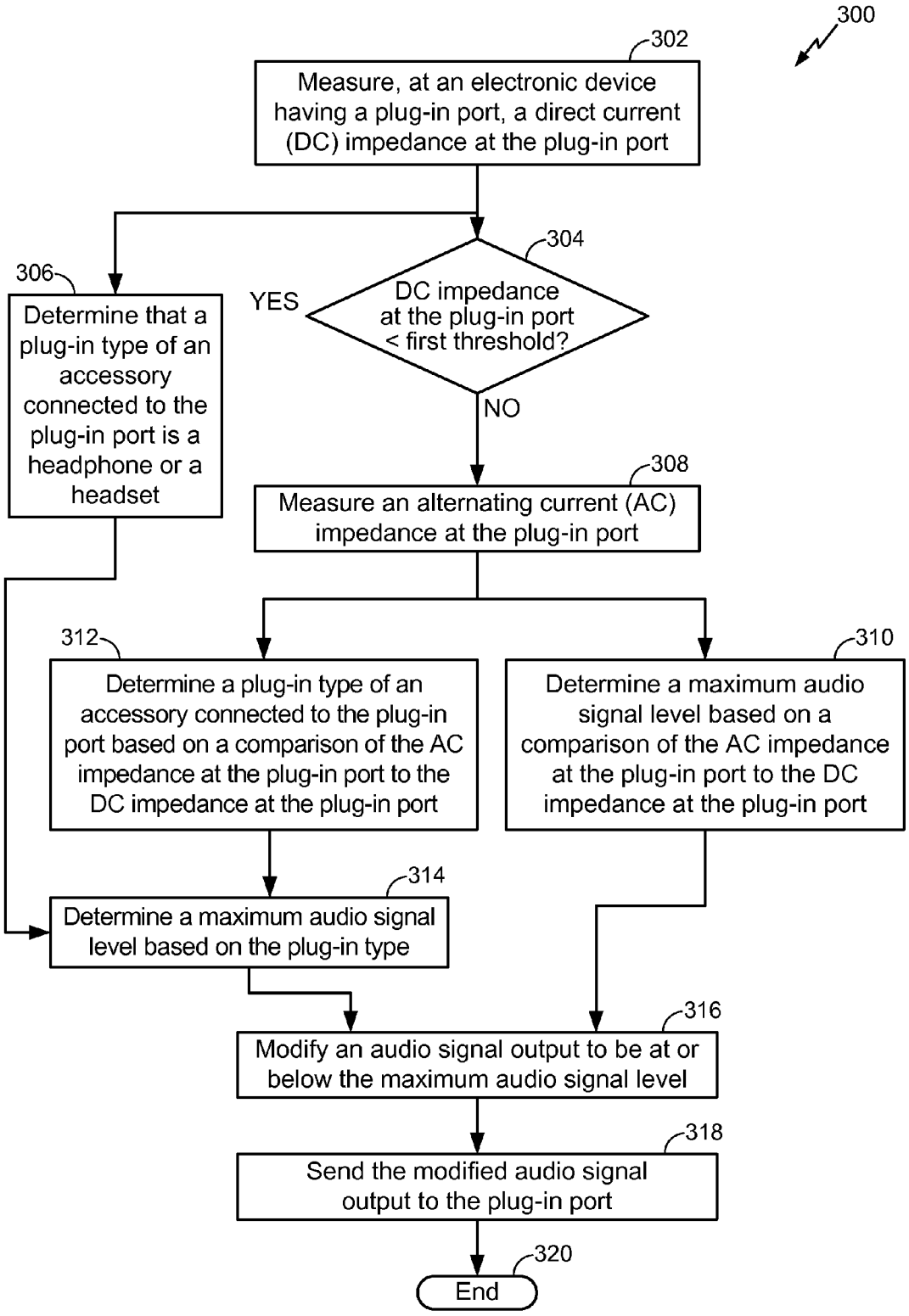
FIG. 3 is a flow diagram illustrating a particular embodiment of a method of determining a maximum audio signal level based on impedance comparison.

Referring to FIG. 3, a particular illustrative embodiment of a method 300 of determining a maximum audio signal level is shown. The method 300 may include measuring, at an electronic device having a plug-in port, a direct current (DC) impedance at the plug-in port, at 302. For example, in FIG. 1, the DC impedance may be measured at the plug-in port 104 by the left channel AC and DC impedance detector 108 or the right channel AC and DC impedance detector 118. In an illustrative embodiment, the left channel AC and DC impedance detector 108 or the right channel AC and DC impedance detector 118, may be implemented as described with reference to the channel AC and DC impedance detector 202 illustrated in FIG. 2.

The method 300 may further include determining whether the DC impedance measured at the plug-in port is below a first threshold, at 304. For example, in FIG. 1, the impedance comparator 130 may determine whether the DC impedance measured at the plug-in port 104 is below the first threshold (e.g., about 200 Ohms)

When the DC impedance is below the first threshold, at 304, the method 300 may include determining that a plug-in type of an accessory connected to the plug-in port is a headphone or a headset, at 306. For example, in FIG. 1, the plug-in type detector 132 may determine that the plug-in type of an accessory connected to the plug-in port is a headphone or a headset when the DC impedance is below the first threshold (i.e., about 200 Ohms) The method 300 may proceed to 314.

When the DC impedance is not below the first threshold, at 304, the method 300 may include measuring an alternating current (AC) impedance at the plug-in port, at 308. For example, in FIG. 1, the AC impedance may be measured at a particular frequency at the plug-in port 104 by the left channel AC and DC impedance detector 108 or the right channel AC and DC impedance detector 118. In an illustrative embodiment, the left channel AC and DC impedance detector 108 or the right channel AC and DC impedance detector 118, may be implemented as described with reference to the channel AC and DC impedance detector 202 illustrated in FIG. 2.

The method 300 may further include determining a maximum audio signal level based on a comparison of the AC impedance measured at the plug-in port to the DC impedance at the plug-in port, at 310. For example, in FIG. 1, a comparison of the AC impedance measured at the particular frequency at the plug-in port 104 to the DC impedance measured at the plug-in port 104 may be performed by the impedance comparator 130. The audio signal level determiner 134 may determine a maximum audio signal level based on the comparison performed by the impedance comparator 130.

Alternatively, the method 300 may include determining a plug-in type of an accessory connected to the plug-in port based on a comparison of the AC impedance measured at the particular frequency at the plug-in port to the DC impedance measured at the plug-in port, at 312. In this case, the method 300 further includes determining a maximum audio signal level based on the plug-in type, at 314. For example, the plug-in type may be a disconnected cable, a line-out, a headset or a headphone, an AC coupled line-out, or some other plug-in type. The audio signal level determiner 134 of FIG. 1 may determine a maximum audio signal level based on the plug-in type.

The method 300 may further include modifying an audio signal output to be at or below the maximum audio signal level, at 316. For example, in FIG. 1, the audio signal adjuster 136 may modify an audio signal output to not exceed the maximum audio signal level.

The method 300 may also include sending the modified audio signal output to the plug-in port, at 318. For example, in FIG. 1, the audio signal adjuster 136 may communicate the modified audio signal output to the plug-in port 104. The method 300 may end, at 320.

Thus, the method 300 may be used to evaluate a type of a particular device received at a plug-in port by comparing AC impedance values and DC impedance values to accurately assess a type of the device in order to set a maximum audio signal level. The maximum audio signal level may be used to adjust the audio output to beneficially match the particular type of device. The maximum audio signal level may be based on regulatory or industry standards to ensure that the audio signal output stays within a safe maximum level to prevent ear damage due to exposure to loud noise, to prevent damage to the plug-in device, or both. For example, a safe maximum level to prevent ear damage and to prevent damage to the plug-in device (e.g., headsets/headphones or line-out) may be lower for headsets or headphones than for line-out. Upon identifying the type of device, the maximum audio signal level may be modified to be within the safe maximum level corresponding to identified type of device.

Figure 4:
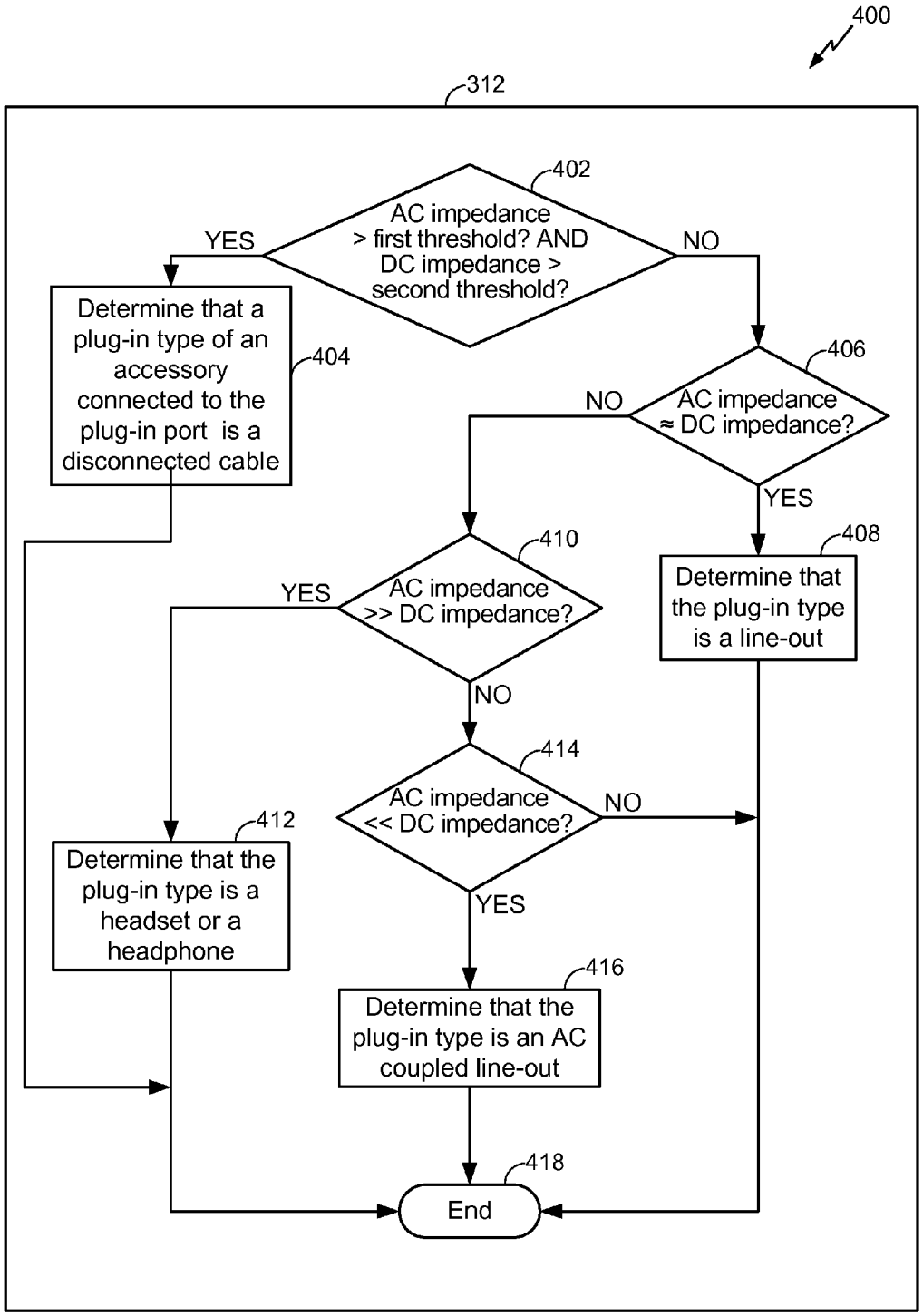
FIG. 4 is a flow diagram illustrating a particular embodiment of a method of detecting plug-in type based on impedance comparison.

Referring to FIG. 4, a particular illustrative embodiment of a method 400 of determining a plug-in type is shown. In a particular embodiment, the method 400 corresponds to the operation 312 of FIG. 3. The method 400 may include determining whether an AC impedance (measured at a particular frequency at the plug-in port) is greater than a first threshold and whether a DC impedance (measured at the plug-in port) is greater than a second threshold, at 402. In a particular embodiment, the first threshold may be the same as the second threshold. In another particular embodiment, the first threshold may be distinct from the second threshold. In a particular embodiment, the first threshold may be approximately 10 percent below a first maximum impedance detection level (e.g., a maximum impedance level that the AC impedance detector 208 of FIG. 2 is capable of detecting). In a particular embodiment, the second threshold may be approximately 10 percent below a second maximum impedance detection level (e.g., a maximum impedance level that the DC impedance detector 218 of FIG. 2 is capable of detecting). When the AC impedance is greater than the first threshold and the DC impedance is greater than the second threshold, the method 400 may include determining that the plug-in type is a disconnected cable, at 404. The method 400 may end, at 418.

When the AC impedance is not greater than the threshold and the DC impedance is not greater than the threshold, the method 400 may include determining whether the AC impedance is substantially equal to the DC impedance, at 406. When the AC impedance is substantially equal to the DC impedance (e.g., subject to an error tolerance), the method 400 may include determining that the plug-in type is a line-out, at 408. The method 400 may end, at 418.

When the AC and DC impedances are not substantially equal, the method 400 may further include determining whether the AC impedance is significantly greater than the DC impedance (e.g., the AC impedance is greater than the DC impedance by more than a threshold amount, a particular percentage, a multiple, etc.), at 410. For example, the AC impedance may be significantly greater than the DC impedance. A difference between the AC impedance and the DC impedance is sufficient to rule out errors in measurement of the AC impedance and the DC impedance. When the AC impedance is significantly greater than the DC impedance, the method 400 may include determining that the plug-in type is a headset or a headphone, at 412. The method 400 may end, at 418.

When the AC impedance is not significantly greater than the DC impedance, the method 400 may include determining whether the AC impedance is significantly less than the DC impedance (e.g., the AC impedance is less than the DC impedance by more than a threshold amount, a particular percentage, a multiple, etc.), at 414. For example, the AC impedance may be significantly less than the DC impedance. A difference between the DC impedance and the AC impedance is sufficient to rule out errors in measurement of the AC impedance and the DC impedance. When the AC impedance is significantly less than the DC impedance, the method 400 may include determining that the plug-in type is an AC coupled line-out, at 416. The method 400 may end, at 418.

In a particular embodiment, if the AC impedance and the DC impedance are not substantially equal, at 406, but the AC impedance cannot be determined to be significantly higher than the DC impedance (e.g., at 410), and the AC impedance cannot be determined to be significantly lower than the DC impedance (e.g., at 414), then the plug-in type may not be determined within an acceptable certainty or confidence. In this case, no determination may be made or other processing may be performed achieve an acceptable comparison of the AC and DC impedances.

Figure 5:
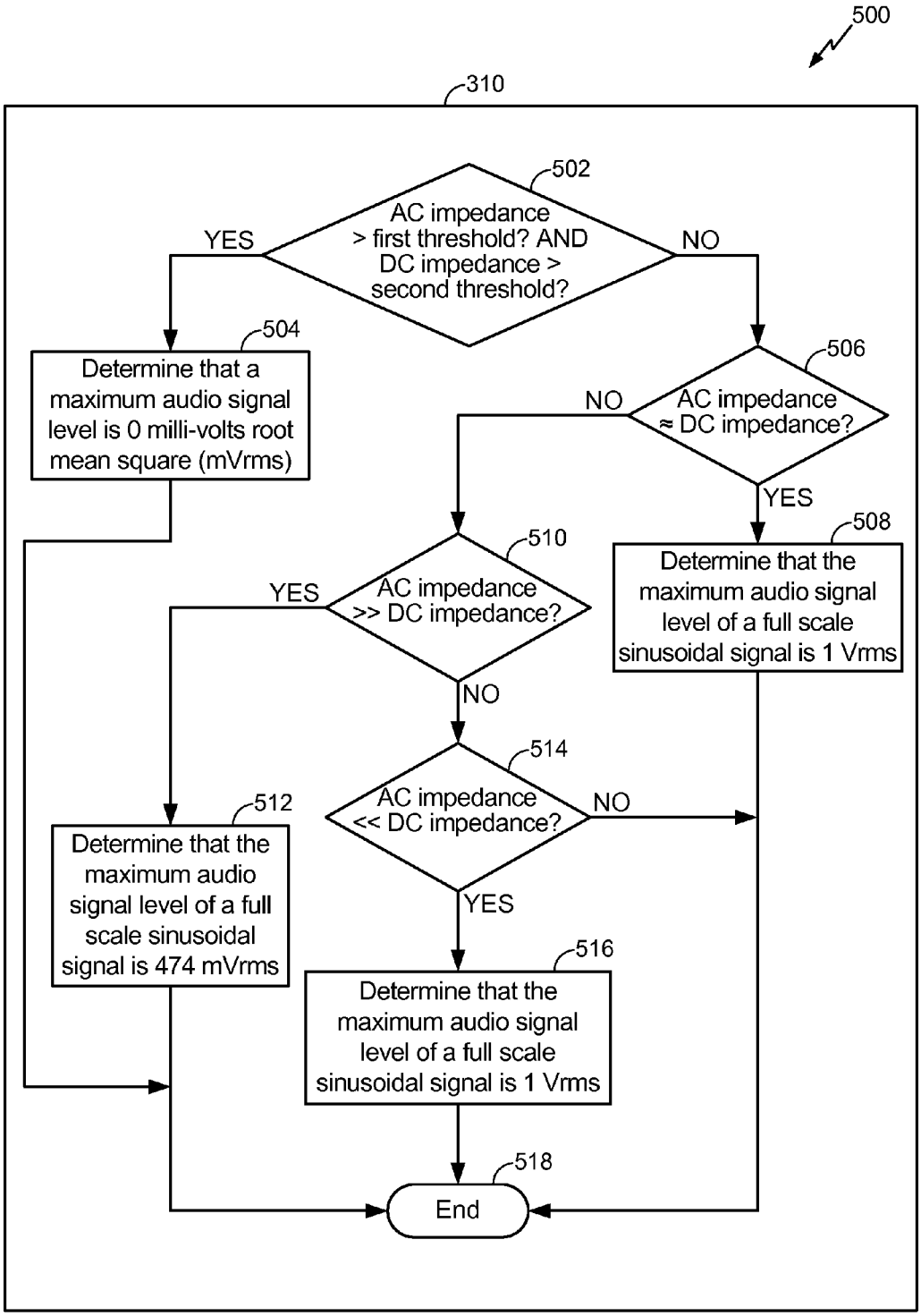
FIG. 5 is a flow diagram illustrating another particular embodiment of a method of determining a maximum audio signal level based on impedance comparison.

Referring to FIG. 5, a particular illustrative embodiment of a method of determining a maximum audio signal level is shown. The method 500 may correspond to the step 310 of determining a maximum audio level referred to in FIG. 3. The method 500 may include making a comparison of AC and DC impedance levels (measured at a plug-in port) vis-à-vis respective thresholds. In particular, if the AC impedance is greater than a first threshold, and the DC impedance is greater than a second threshold, at 502, the method 500 may include setting a maximum audio signal level to 0 milli-volts root mean square (mVrms), at 504. The method 500 may end, at 518.

If the AC impedance is not greater than the first threshold, or the DC impedance is not greater than the second threshold, at 502, the method 500 may include comparing the AC impedance with the DC impedance, at 506. If the AC impedance is substantially equal to the DC impedance, then the method 500 may include setting the maximum audio signal level of a full scale sinusoidal audio signal output via the plug-in port 104 to 1 Vrms, at 508. The method 500 may end, at 518. While 1 Vrms has been used as a representative example, other maximum audio signal levels may be defined depending on various standards, types of signals, or types of devices.

If the AC impedance is not substantially equal to the DC impedance, at 506, the method 500 may include determining, at 510, whether the AC impedance is significantly greater than the DC impedance. If the AC impedance is significantly greater than DC impedance, then the method 500 may include setting the maximum audio signal level of a full scale sinusoidal audio signal output via the plug-in port 104 to 474 mVrms, at 512. The method 500 may end, at 518. While 474 Vrms has been used as a representative example, other maximum audio signal levels may be defined depending on various standards, types of signals, or types of devices.

If the AC impedance is not significantly greater than the DC impedance, at 510, the method 500 may include determining, at 514, whether the AC impedance is significantly lower than the DC impedance. If the AC impedance is not significantly lower than the DC impedance, at 514, the method 500 may end, at 518.

If the AC impedance is significantly lower than the DC impedance, at 514, the method 500 may include setting the maximum audio signal level of a full scale sinusoidal audio signal output via the plug-in port 104 to 1 Vrms, at 516. The method 500 may end, at 518. While 1 Vrms has been used as a representative example, other maximum audio signal levels may be defined depending on various standards, types of signals, or types of devices.

In a particular embodiment, when the AC impedance is not substantially equal to the DC impedance, at 506, and the AC impedance cannot be determined to be significantly greater than the DC impedance (e.g., at 510), and the AC impedance cannot be determined to be significantly lower than the DC impedance (e.g., at 514), then no determination may be made, an error may be reported, a test may be conducted, or other appropriate evaluation of the impedance data may be conducted.

Based on the above methods of comparing AC and DC impedances to determine a maximum audio signal level and a plug-in type of an output device coupled to an output port, a more accurate determination of a plug-in type (and an associated maximum audio signal level) may be performed. The determination of plug-in type and maximum audio signal level as described herein are based on both the DC impedance and the AC impedance measured at the plug-in port (e.g., the plug-in port 104). Thus, a more accurate determination of the plug-in type, including differentiating between plug-in types that have overlapping bandwidth of DC impedance, may be achieved.

An audio signal level output may be modified more reliably based on the more accurate determination of the plug-in type. For example, when a DC impedance (e.g., 1000 Ohms) at the plug-in port falls within an overlapping bandwidth (e.g., between 600 Ohms and 7000 Ohms) and could thus correspond to multiple types of devices (e.g., headphones or line-out), some approaches may choose a lowest maximum audio signal level corresponding the multiple types of devices (e.g., 474 mVrms corresponding to headphones instead of 1 Vrms corresponding to line-out). The user experience may be improved by providing a more appropriate audio signal level output (e.g., when the plug-in type is line-out and not headphones).

Figure 6:
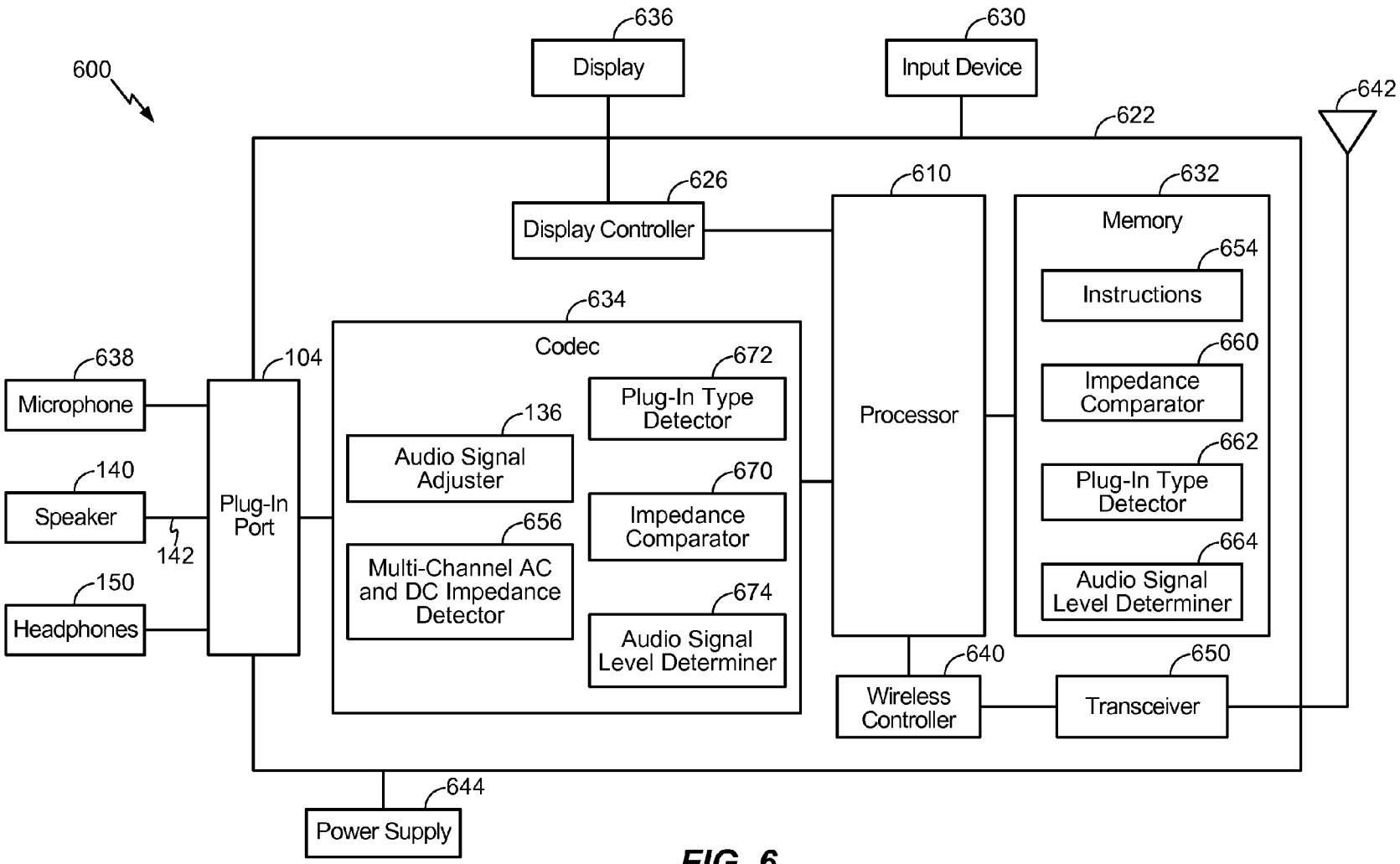
FIG. 6 is a block diagram of a device operable to support embodiments of computer-implemented methods, computer program products, and system components as illustrated in FIGS. 1-5.

FIG. 6 is a block diagram of a particular illustrative embodiment of an electronic device 600 including one or more components operable to detect plug-in type based on impedance comparison. In various embodiments, the electronic device 600 may have more or fewer components than are illustrated in FIG. 6. The electronic device 600 may include, be included within, or correspond to the electronic device 102 of FIG. 1.

In a particular embodiment, the electronic device 600 includes a processor (e.g., central processing unit (CPU) or digital signal processor (DSP)) 610 coupled to a memory 632, to a codec 634, and to a transceiver 650 via a wireless controller 640. The transceiver 650 may be coupled to a wireless antenna 642. The processor 610 may also be coupled to a display 636 via a display controller 626.

A microphone 638, the speaker 140 (e.g., via a line-out cable 142), the headphones 150, or a combination thereof, may be coupled to the codec 634 via the plug-in port 104. The codec 634 or the plug-in port 104 may include or be coupled to a multi-channel AC and DC impedance detector 656 (e.g., one or more channel AC and DC impedance detector(s) 202 of FIG. 2), an impedance comparator 670 (e.g., the impedance comparator 130 of FIG. 1), a plug-in type detector 672 (e.g., the plug-in type detector 132 of FIG. 1), an audio signal level determiner 674 (e.g., the audio signal level determiner 134), and an audio signal adjuster 136. Thus, the codec 634 or the plug-in port 104 may be used to implement a hardware embodiment of the plug-in type detection technique described herein.

Alternately, or in addition, a software embodiment (or combined hardware/software embodiment) may be implemented. For example, the memory 632 may include an impedance comparator 660 (e.g., the impedance comparator 130 of FIG. 1), a plug-in type detector 662 (e.g., the plug-in type detector 132 of FIG. 1), an audio signal level determiner 664 (e.g., the audio signal level determiner 134 of FIG. 1), or a combination thereof. The impedance comparator 660, the plug-in type detector 662, the audio signal level determiner 664, or a combination thereof may correspond to instructions 654 executable by the processor 610 or other processing unit of the electronic device 600.

In a particular embodiment, the electronic device 600 may be included in a system-in-package or system-on-chip device 622. In a particular embodiment, an input device 630 and a power supply 644 are coupled to the system-on-chip device 622. Moreover, in a particular embodiment, as illustrated in FIG. 6, the display 636, the input device 630, the speaker 140, the headphones 150, the microphone 638, the wireless antenna 642, and the power supply 644 are external to the system-on-chip device 622. However, each of the display 636, the input device 630, the speaker 140, the headphones 150, the microphone 638, the wireless antenna 642, and the power supply 644 can be coupled to a component of the system-on-chip device 622, such as an interface or a controller.

The electronic device 600 may include a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, a navigation device, or a combination thereof.

In an illustrative embodiment, the processor 610, the codec 634, and/or components thereof may be operable to perform all or a portion of the operations and methods described with reference to FIGS. 1-5. For example, an AC impedance and a DC impedance may be detected at the plug-in port 104 (e.g., a 3.5 millimeter (mm) port). The AC impedance may be based on a single channel of the plug-in port 104 or based on an average of AC impedances corresponding to a plurality of channels of the plug-in port 104. Similarly, the DC impedance may be based on a single channel of the plug-in port 104 or based on an average of DC impedances corresponding to a plurality of channels of the plug-in port 104.

A maximum audio signal level may be determined based on a comparison of the AC impedance and the DC impedance. For example, the maximum audio signal level may be determined to be 0 mVrms in response to determining that the AC impedance and the DC impedance are each above a threshold. The maximum audio signal level of a full scale sinusoidal audio signal output via the plug-in port 104 may be determined to be 474 Vrms in response to determining that the AC impedance is substantially higher than the DC impedance.

The maximum audio signal level of a full scale sinusoidal audio signal output via the plug-in port 104 may be determined to be 1 Vrms in response to determining that the AC impedance is substantially equal to the DC impedance or in response to determining that the AC impedance is substantially lower than the DC impedance. An audio signal output level may be modified based on the maximum audio signal level.

In conjunction with the described embodiments, an apparatus includes means for comparing an alternating current (AC) at a plug-in port to a direct current (DC) impedance at the plug-in port. For example, the means for comparing may include the impedance comparator 130 of FIG. 1, the impedance comparator 670 of FIG. 6, the impedance comparator 660 of FIG. 6, the processor 610 of FIG. 6 or component(s) thereof, one or more other devices or circuits configured to compare an AC impedance to a DC impedance, or any combination thereof.

The apparatus also includes means for determining a plug-in type of an accessory connected to the plug-in port based on the comparison. For example, the means for determining the plug-in type may include the plug-in type detector 132 of FIG. 1, the plug-in type detector 672 of FIG. 6, the plug-in type detector 662 of FIG. 6, the processor 610 of FIG. 6 or component(s) thereof, one or more other devices or circuits configured to determine a plug-in type, or any combination thereof The apparatus further includes means for determining a maximum audio signal level based on the plug-in type. For example, the means for determining the maximum audio signal level may include the audio signal level determiner 134 of FIG. 1, the audio signal level determiner 674 of FIG. 6, the audio signal level determiner 664 of FIG. 6, the processor 610 or component(s) thereof, one or more other devices or circuits configured to determine a maximum audio signal level, or any combination thereof.

In a particular embodiment, the plug-in port, the plug-in type detector, and the impedance comparator may be integrated into one of a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, and a navigation device.

Those of skill would further appreciate that the various illustrative logical blocks, configurations, modules, circuits, and algorithm steps described in connection with the embodiments disclosed herein may be implemented as electronic hardware, computer software, or combinations of both. Various illustrative components, blocks, configurations, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transitory storage medium. An exemplary storage medium is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal (e.g., a mobile phone or a PDA). In the alternative, the processor and the storage medium may reside as discrete components in a computing device or user terminal For example, one or more processors (or components thereof) configured to perform functionality described herein may be integrated into a set top box, an entertainment unit, a navigation device, a communications device, a personal digital assistant (PDA), a fixed location data unit, a mobile location data unit, a mobile phone, a cellular phone, a computer, a portable computer, a desktop computer, a monitor, a computer monitor, a television, a tuner, a radio, a satellite radio, a music player, a digital music player, a portable music player, a video player, a digital video player, a digital video disc (DVD) player, a portable digital video player, a tablet computing device, or any combination thereof.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments disclosed herein but is to be accorded the widest scope possible consistent with the principles and novel features as defined by the following claims.

What is claimed is:

1. A method comprising:

determining, at an electronic device having a plug-in port, a plug-in type of an accessory connected to the plug-in port based on a comparison of an alternating current (AC) impedance at the plug-in port to a direct current (DC) impedance at the plug-in port.

2. The method of claim 1, further comprising:

in response to determining that the AC impedance is substantially equal to the DC impedance, determining that the plug-in type is a line-out, wherein the DC impedance is above a first threshold.

3. The method of claim 1, further comprising:

in response to determining that the AC impedance is substantially lower than the DC impedance, determining that the plug-in type is an AC coupled line-out.

4. The method of claim 1, further comprising:

in response to determining that the AC impedance is above a first threshold and that the DC impedance is above a second threshold, determining that the plug-in type is a disconnected cable.

5. The method of claim 1, further comprising:

in response to determining that the AC impedance is substantially higher than the DC impedance, determining that the plug-in type is a headset or a headphone.

6. The method of claim 1, further comprising:

determining a maximum audio signal level based on the plug-in type.

7. The method of claim 6, further comprising:

modifying an audio signal output to be at or below the maximum audio signal level; and sending the modified audio signal output to the plug-in port.

8. The method of claim 1, further comprising measuring the AC impedance at the plug-in port.

9. The method of claim 8, wherein measuring the AC impedance comprises comparing a detected AC voltage to a reference voltage.

10. The method of claim 8, wherein measuring the AC impedance comprises:

applying a first voltage at a frequency to a resistor having a resistance;

detecting a second voltage at a voltage detection point; and multiplying the second voltage with a ratio of the resistance and the first voltage.

11. The method of claim 8, wherein the AC impedance is measured at a frequency of approximately 100 hertz (Hz).

12. The method of claim 1, further comprising measuring the DC impedance at the plug-in port.

13. The method of claim 1, wherein the electronic device comprises a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, a navigation device, or a combination thereof.

14. A non-transitory computer-readable medium storing instructions that, when executed by a processor, cause the processor to:

determine maximum audio signal level based on a comparison of an alternating current (AC) impedance at a plug-in port to a direct current (DC) impedance at the plug-in port.

15. The non-transitory computer-readable medium of claim 14, further storing instructions that, when executed by the processor, cause the processor to:

in response to determining that the AC impedance is above a first threshold and that the DC impedance is above a second threshold, determine that the maximum audio signal level is 0 milli-volts root mean square (mVrms).

16. The non-transitory computer-readable medium of claim 14, further storing instructions that, when executed by the processor, cause the processor to:

in response to determining that the AC impedance is substantially higher than the DC impedance, determine that the maximum audio signal level of a full scale sinusoidal signal is 474 milli-volts root mean square (mVrms).

17. The non-transitory computer-readable medium of claim 14, further storing instructions that, when executed by the processor, cause the processor to:

in response to determining that the AC impedance is substantially equal to the DC impedance, determine that the maximum audio signal level of a full scale sinusoidal signal is 1 volt root mean square (Vrms), wherein the DC impedance is above a first threshold.

18. The non-transitory computer-readable medium of claim 14, further storing instructions that, when executed by the processor, cause the processor to:

in response to determining that the AC impedance is substantially lower than the DC impedance, determine that the maximum audio signal level of a full scale sinusoidal signal is 1 volt root mean square (Vrms).

19. The non-transitory computer-readable medium of claim 14, wherein the plug-in port is a 3.5 millimeter (mm) port.

20. The non-transitory computer-readable medium of claim 14, wherein the AC impedance is determined based on a single channel of the plug-in port.

21. The non-transitory computer-readable medium of claim 14, wherein the AC impedance is determined based on an average of a first AC impedance of a first channel of the plug-in port and a second AC impedance of a second channel of the plug-in port.

22. The non-transitory computer-readable medium of claim 14, wherein the DC impedance is determined based on a single channel of the plug-in port.

23. An apparatus comprising:

a plug-in type detector configured to determine a plug-in type of an accessory connected to a plug-in port based on a comparison of an alternating current (AC) impedance at the plug-in port to a direct current (DC) impedance at the plug-in port.

24. The apparatus of claim 23, wherein the DC impedance is determined based on an average of a first DC impedance of a first channel of the plug-in port and a second DC impedance of a second channel of the plug-in port.

25. An apparatus comprising:

means for comparing an alternating current (AC) impedance at a plug-in port to a direct current (DC) impedance at the plug-in port; and means for determining a plug-in type of an accessory connected to the plug-in port based on the comparison.

26. The apparatus of claim 25, further comprising means for determining a maximum audio signal level based on the plug-in type.

27. The apparatus of claim 26, wherein the means for comparing the AC impedance at the plug-in port to the DC impedance at the plug-in port, the means for determining the plug-in type, and the means for determining the maximum audio signal level are integrated into one of a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, and a navigation device.

28. An apparatus comprising:

a plug-in port;

a plug-in type detector configured to determine a plug-in type of an accessory connected to the plug-in port based on a comparison of an alternating current (AC) impedance at the plug-in port to a direct current (DC) impedance at the plug-in port; and an impedance comparator configured to:

receive an AC impedance value representative of the AC impedance at the plug-in port;

receive a DC impedance value representative of the DC impedance at the plug-in port;

compare the AC impedance value to the DC impedance value; and provide a result of the comparison to the plug-in type detector.

29. The apparatus of claim 28, further comprising:

a left channel AC and DC impedance detector coupled to the plug-in port via a left channel, the left channel AC and DC impedance detector configured to:

provide a left channel AC impedance value to the impedance comparator, the left channel AC impedance value representative of the AC impedance of the left channel at the plug-in port; and provide a left channel DC impedance value to the impedance comparator, the left channel DC impedance value representative of the DC impedance of the left channel at the plug-in port; and a right channel AC and DC impedance detector coupled to the plug-in port via a right channel, the right channel AC and DC impedance detector configured to:

provide a right channel AC impedance value to the impedance comparator, the right channel AC impedance value representative of the AC impedance of the right channel at the plug-in port; and provide a right channel DC impedance value to the impedance comparator, the right channel DC impedance value representative of the DC impedance of the right channel at the plug-in port.

30. The apparatus of claim 28, further comprising:

an audio signal level determiner configured to select a maximum audio signal level of the plug-in port based on the plug-in type; and an audio signal adjuster configured to:

modify an audio signal output based on the maximum audio signal level; and send the modified audio signal output to the plug-in port.

31. The apparatus of claim 28, wherein the plug-in port, the plug-in type detector, and the impedance comparator are integrated into one of a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, and a navigation device.

* * * * *